US005742966A

United States Patent [19]

Tono

[11] Patent Number: 5,742,966

[45] Date of Patent: Apr. 28, 1998

[54] FLOOR-CLEANING MACHINE PROVIDED WITH MOVABLE BRUSHES AND DRAGGING DISC

[76] Inventor: Gianni Tono, 11, via Locchi, Padova 35124, Italy

[21] Appl. No.: 535,820

[22] Filed: Sep. 28, 1995

[30] Foreign Application Priority Data

| | | | |
|---|---|---|---|
| Oct. 5, 1994 | [IT] | Italy | PD940105 U |
| Dec. 2, 1994 | [IT] | Italy | PD94A0212 |
| Feb. 21, 1995 | [IT] | Italy | PD95A0045 |

[51] Int. Cl.[6] ..... A47L 11/16; A47L 11/283

[52] U.S. Cl. ..... 15/49.1; 15/87

[58] Field of Search ..... 15/52.1, 49.1, 15/50.1, 87

[56] References Cited

U.S. PATENT DOCUMENTS

| | | | |
|---|---|---|---|
| 993,603 | 5/1911 | Jones | 15/87 |
| 3,020,573 | 2/1962 | Descarries | 15/49.1 |
| 4,319,434 | 3/1982 | Brejcha | 15/49.1 |
| 4,862,548 | 9/1989 | Seagio | 15/49.1 |
| 5,231,724 | 8/1993 | Haaga | 15/49.1 |

FOREIGN PATENT DOCUMENTS

| | | | |
|---|---|---|---|
| 59275 | 4/1977 | Australia | 15/49.1 |
| 1271628 | 8/1961 | France | 15/87 |
| 51204 | 3/1890 | Germany | 15/49.1 |
| 2709193 | 9/1978 | Germany | 15/49.1 |
| 3144004 | 6/1991 | Japan | 15/49.1 |
| 61-54143 | 6/1994 | Japan | 15/50.1 |
| 67398 | 2/1914 | Switzerland | 15/49.1 |
| 119664 | 6/1927 | Switzerland | 15/49.1 |

*Primary Examiner*—Randall Chin

[57] ABSTRACT

The invention is a new floor-cleaning machine, with brushes and motor mounted on a support which travels sidewards; the motor is positioned on the side opposite to the travelling direction of the support, in such a way as to allow the brush to protrude. The support can also rotate on the vertical axis so as to move the two brushes from the position in which they are aligned to the position in which they are side by side. The brushes can be provided with traditional discs or with a dragging disc equipped with two concentric elements made of rubber with different densities, owing to which the dragging disc edges maintain their correct shape over time.

3 Claims, 2 Drawing Sheets

FLOOR-CLEANING MACHINE PROVIDED WITH MOVABLE BRUSHES AND DRAGGING DISC

BACKGROUND OF THE INVENTION

1. Field of the Invention

The present invention concerns floor-cleaning machines.

2. Description of the Related Art

At present several kinds of machines are used for the removal of dirt from floors and for washing and drying floors, which are provided having two rotary brushes with vertical axis. These cleaning machines are provided with brushes arranged one slightly forward with respect to the other and near each other, so that during the advance of the machine the floor strip on which one brush works partially superimposes that on which the other brush works.

The rotation of the brushes is usually obtained by means of one or two motors; if the machine is provided with two motors, each of them is coaxial with the respective to the brush; if, on the contrary, it is provided with a single motor, the motor is placed directly on one brush, which transmits motion to the other by contact or through a belt.

The brushes and the motor are mounted on a single plate which can be moved or rotated sidewards by means of a mechanism; in this way part of one brush protrudes from the outline of the floor-cleaning machine, thus making it possible to clean the edges of rooms and corridor.

The lateral movement of the plate supporting the brushes and the motor is quite limited, since it is hindered by the motor itself; in fact the plate can travel covering a distance equal to the distance of the motor from the frame edge.

In order to clean room edges or to clean the floor under pieces of furniture which are rather deep and under which there is no sufficient space for the floor-cleaning machine, it is necessary to be able to move the brushes laterally.

Another drawback is represented by the fact that with the known kinds of floor-cleaning machines it is not possible to clean those corners which cannot be reached by the brushes.

SUMMARY OF THE INVENTION

In order to eliminate these drawbacks, a new kind of floor-cleaning machine has been designed and implemented. This new machine is provided with a movable horizontal support for the two brushes and for the motor.

The motor is located on the horizontal support in backward position with respect to the front part of the machine, either on the right or on the left side, and transmits the rotary motion to the brushes by means of a belt; the brushes are made to rotate in opposite directions with respect to each other.

A lever and/or pin articulated system makes it possible to move the support laterally, to the side opposite that on which the motor is positioned, so that the brushes protrude as much as possible from the structure of the floor-cleaning machine.

The shift of the support and of the brushes is nearly equal to the distance of the motor from the structure of the machine in the direction of movement, that is, it nearly equals the whole width of the support or is such that the brush protrudes almost completely from the structure of the machine.

The lateral shift of the horizontal support is much greater than in the known kind of floor-cleaning machines and makes it possible to clean the floor also under pieces of furniture, shelves and alike.

Further, by means of levers and/or pins which make the support advance in addition to shifting it laterally, thus allowing the brushes to be moved forward to the right or to the left, it is possible to clean comfortably also room corners.

The floor strip covered by the brushes at each passage is constant; this means that the machine cannot go under certain kinds of tables or furniture, nor between too narrow shelves.

Further, the central strip of the surface covered by the machine is cleaned by both brushes, which is rather useless for not excessively dirty floors.

It can thus be easily understood that the floor-cleaning machines used at present do not make it possible to clean limited spaces, which makes it necessary to use a second, smaller machine or to clean the floor by hand.

Besides, the horizontal support can be connected with the machines by means of a vertical pin or proper levers, which ensure the rotation of the support and therefore of the brushes on a vertical axis.

It is clear that this new machine makes it possible to clean large, not excessively dirty rooms and also the surfaces under tables or small pieces of furniture.

When it is necessary to clean large rooms that are not very dirty, the support must be moved so that the brushes are positioned side by side with respect to the advance of the machine.

When, on the contrary, it is necessary to clean narrow spaces, the horizontal support must be rotated until the brushes are aligned one behind the other with respect to the advance of the machine.

When there are no space problems, but it is necessary to clean the floor thoroughly, the horizontal support must be rotated so that the surface covered by one brush partially superimposes the surface covered by the other brush.

In an alternative embodiment, the machines can also be equipped with one or more dragging discs comprising a rotary plate made of rigid material which supports a soft rubber disc. A polishing cloth or an abrasive disc, which polish or scrape the floor by rotating, are applied on the rubber disc with Velcro strips.

The rubber disc tends to get compact along the edges over time, thus taking a convex shape with raised edges.

Therefore, the disc does not adhere completely to the floor surface any more and tends to polish the floor not uniformly and to reduce the polished surface. This is extremely negative especially during the polishing (abrasion) of the floor zones nearest to the walls.

Many machines are normally provided with two slightly staggered discs, in such a way as to ensure uniform polishing (abrasion) of the floor; however, since both dragging discs are subject to deformation, after the polishing (abrasion) a floor strip results inadequately polished in its central part.

The new dragging disc comprises a rotary plate made of rigid material with a disc having the internal part made of rubber and an external crown made of rubber, too, but characterized by higher density.

The external crown is thus more rigid and is not subject to any compacting action, therefore the usual convex deformations are eliminated and the shape of the crown itself remains perfectly straight.

The constantly correct shape of the external disc always ensures total adherence of the cloth to the floor and therefore uniform polishing (abrasion) also near walls.

Practically, the invention is a new floor-cleaning machine provided with two rotary brushes with vertical axis, wherein the innovative concept lies in the fact that a movable support for said brushes is provided, on which the motor is positioned completely rightward or leftward, so that the greatest possible movement of the support itself and consequently of the brushes is ensured. In the new floor-cleaning machine said support can be a rotary support, so that a variable arrangement of the two brushes is also possible. The support rotates on a vertical axis from a position in which the brushes side by side to a position in which they are aligned and to any intermediate position.

The following is just an example among many of the practical embodiments of the invention in question, illustrated in the attached drawings.

BRIEF DESCRIPTION OF THE DRAWINGS

FIG. 3 is a top plan view of a modified embodiment of the invention shown in FIGS. 1 and 2;

FIGS. 1 and 2 are schematic plan views of the front part of the floor-cleaning machine, in which the outline (M) of the machine itself is represented having a front portion 20, rear portion 21 and opposite side portions 22 and 23.

DESCRIPTION OF THE PREFERRED EMBODIMENTS

Figure 2:
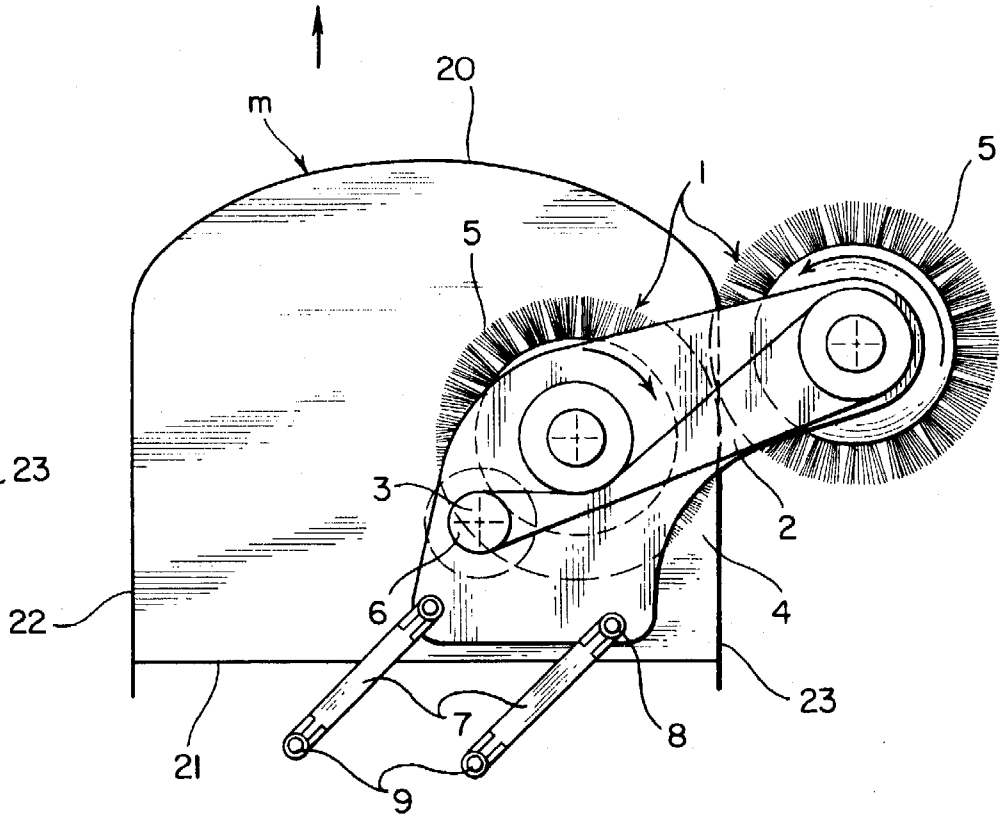
FIG. 2 is a top plan view of the embodiment of FIG. 1 showing the rotating brushes in a different position.

The two brushes (1) are mounted on a support (2) which holds also the motor (3). The two brushes (1) are arranged one forward with respect to the other and near each other, so that during the advance of the machine the floor strips they cover are partially superimposed.

The motor (3) is located on the support (2) in a position at the back and side with respect to the support (2) motion is transmitted by the motor (3) to the brushes (1) by means of a belt (4) connected with two suitable pulleys (5) coaxial with the brushes (1) and with a third pulley (6) coaxial with the motor (3).

The support (2) is linked to the structure of the floor-cleaning machine by moving consisting of parallel rods (7) connected with a couple of pins (8) located on the support (2) and with a couple of pins (9) located on the structure of the floor cleaning machine; additional moving means like pneumatic or hydraulic pistons, electric motors or alike move the support (2) from a central position (FIG. 1) to a lateral position (FIG. 2), in which the most external brush (1) is outside the outline (M) of the machine.

FIG. 3 is a schematic plan view of the floor-cleaning machine, where the outline (M) of the machine itself is represented having a front portion 20, rear portion 21 and opposite side portions 22 and 23.

Figure 1:
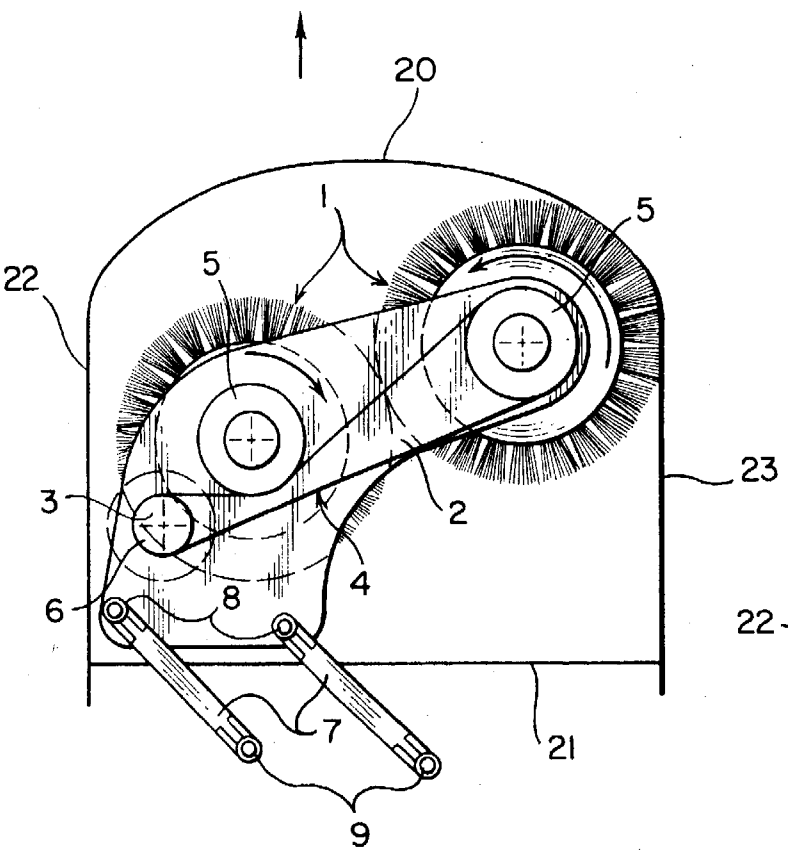
FIG. 1 is a top plan view of a first embodiment of the present invention.
Figures 4, 5, 6, 7:
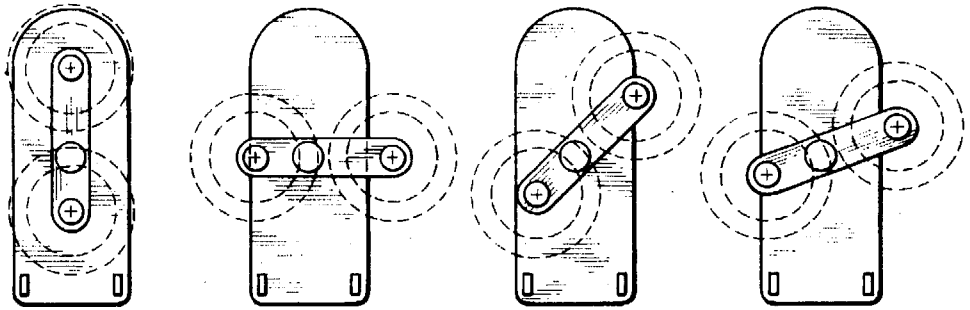
FIGS. 4–7 are schematic illustrational views showing the embodiment of FIG. 3 with the rotating brushes being oriented in different positions.

The two brushes (1) are mounted on a support (**2*b*) rotating on an axis (14); said support (2*b*) holds also the motor (3) which is connected with the brushes (1) using drive elements the disclosed with respect to the embodiment of FIGS. 1 and 2**.

The brushes include drive pulleys 5 driven by a belt 4 which passes about a driving pulley 6 associated with the motor.

The wheels (16) ensure the stability and controllability of the machine.

FIGS. from 4 to 7 show some possible positions of the horizontal support (**2*b*) and of the brushes (1**).

Figure 8:
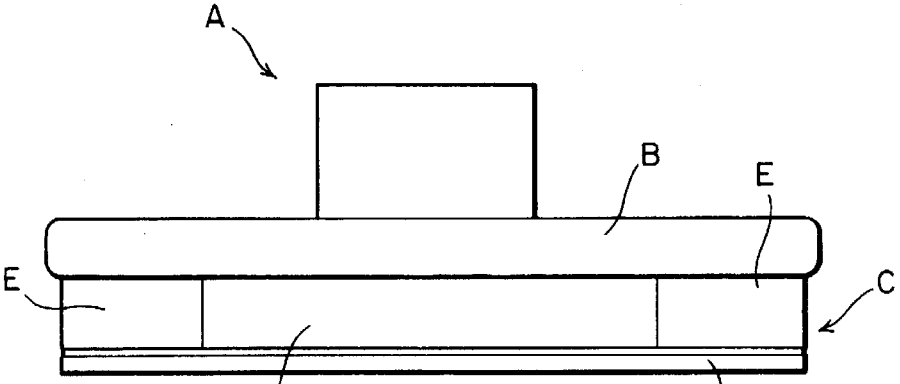
FIG. 8 is a cross sectional view of another embodiment of the present invention showing a dragging disc.
Figure 9:
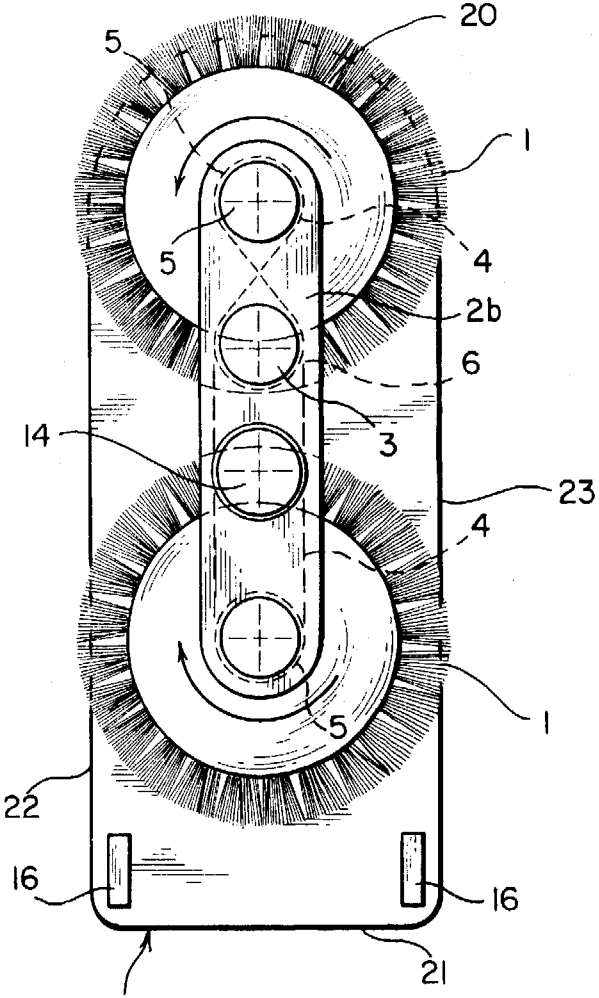

FIG. 8 shows a section of the dragging disc (A) comprising a rotary plate (B) made of rigid material, which supports a rubber disc (C) to which a polishing cloth (D) is applied by means of Velcro strips.

The disc (C) in turn comprises two elements (E) and (F) made of rubber having different densities; the external crown (E) is made of high-density rubber and the internal part (F) of low-density rubber.

Being made of harder rubber, the external crown (E) is not subject to deformations and therefore ensures the maximum adherence of the polishing cloth (D).

The above are the basic outlines of the invention, on the basis of which the technician will be able to provide for implementation; therefore, any change which may be necessary upon implementation is to be regarded as completely protected by the present invention.

With reference to the above description and the attached drawings, the following claims are put forth.

I claim:

1. A floor cleaning machine having front, rear and opposite sides defining an outline of the machine, comprising:

a common support movably mounted to the machine;

at least two rotary brushes mounted to said common support about two spaced vertical axes of rotation;

a motor positioned in spaced relationship from said at least two rotary brushes on said common support;

said at least two rotary brushes and said motor being simultaneously movable with said common support, drive means for drivingly connecting said motor to said at least two rotary brushes; and said common support being moveable from a central position in which said at least two rotary brushes are inside of the outline of the floor cleaning machine to a lateral position in which at least one of said at least two rotary brushes extends outside of the outline of the floor cleaning machine.

2. The floor cleaning machine of claim 1 wherein each of said at least two rotary brushes includes a drive pulley, said drive means including a drive belt connected to said motor and engaging each of said drive pulleys.

3. A floor-cleaning machine having front, rear and opposite sides defining an outline of the machine, comprising:

a support movably mounted to the machine;

at least two rotary brushes mounted to said support, each of said at least two rotary brushes having a separate vertical axis of rotation;

a motor mounted to said support;

drive means for drivingly connecting said motor to said at least two rotary brushes; and said support for said at least two rotary brushes and for said motor rotates about a vertical axis from a central position in which said at least two rotary brushes are aligned with one another substantially within the outline of the floor cleaning machine and between the front and rear of the machine to a lateral position in which said at least two rotary brushes extend outside of the outline of the floor cleaning machine relative to the opposite sides thereof.

* * * * *